US010066835B2

(12) United States Patent
Karkow et al.

(10) Patent No.: US 10,066,835 B2
(45) Date of Patent: Sep. 4, 2018

(54) COMBUSTION SYSTEM WITH FLAME LOCATION ACTUATION

(71) Applicant: ClearSign Combustion Corporation, Seattle, WA (US)

(72) Inventors: Douglas W. Karkow, Des Moines, WA (US); Joseph Colannino, Bellevue, WA (US); Igor A. Krichtafovitch, Kirkland, WA (US); Robert E. Breidenthal, Seattle, WA (US); Christopher A. Wiklof, Everett, WA (US)

(73) Assignee: CLEARSIGN COMBUSTION CORPORATION, Seattle, WA (US)

( * ) Notice: Subject to any disclaimer, the term of this patent is extended or adjusted under 35 U.S.C. 154(b) by 304 days.

(21) Appl. No.: 15/035,465

(22) PCT Filed: Nov. 10, 2014

(86) PCT No.: PCT/US2014/064892

§ 371 (c)(1),
(2) Date: May 9, 2016

(87) PCT Pub. No.: WO2015/070188

PCT Pub. Date: May 14, 2015

(65) Prior Publication Data

US 2016/0290639 A1 Oct. 6, 2016

Related U.S. Application Data

(60) Provisional application No. 61/901,746, filed on Nov. 8, 2013.

(51) Int. Cl.
*F23Q 9/10* (2006.01)
*F23C 5/08* (2006.01)
(Continued)

(52) U.S. Cl.
CPC ..... *F23N 1/005* (2013.01); *F23C 5/02* (2013.01); *F23C 99/001* (2013.01); *F23D 11/42* (2013.01);
(Continued)

(58) Field of Classification Search
CPC ..... F23Q 9/08; F23Q 9/10; F23Q 9/00; F23Q 13/02; F23C 99/001; F23C 2201/20;
(Continued)

(56) References Cited

U.S. PATENT DOCUMENTS 2,095,065 A 10/1937 Hays
2,604,936 A 7/1952 Kaehni et al.
(Continued)

FOREIGN PATENT DOCUMENTS

EP 0844434 5/1998
EP 1139020 8/2006
(Continued)

OTHER PUBLICATIONS

F. Altendorfner et al., Electric Field Effects on Emissions and Flame Stability with Optimized Electric Field Geometry, the European Combustion Meeting ECM 2007, 2007, Fig. 1, Germany.
(Continued)

*Primary Examiner* — Gregory Huson
*Assistant Examiner* — Daniel E Namay
(74) *Attorney, Agent, or Firm* — Christopher A. Wiklof; Nicholas S. Bromer; Launchpad IP, Inc.

(57) ABSTRACT

A combustion system includes an electrically actuated flame location control mechanism.

33 Claims, 12 Drawing Sheets

(51) Int. Cl.

| | |
|---|---|
| ***F23Q 13/02*** | (2006.01) |
| ***F23D 14/26*** | (2006.01) |
| ***F23C 99/00*** | (2006.01) |
| ***F23N 1/00*** | (2006.01) |
| ***F23C 5/02*** | (2006.01) |
| ***F23D 11/42*** | (2006.01) |
| ***F23D 14/72*** | (2006.01) |
| ***F23N 5/18*** | (2006.01) |
| ***F23Q 9/08*** | (2006.01) |

(52) U.S. Cl.

CPC ..... *F23D 14/26* (2013.01); *F23D 14/72* (2013.01); *F23N 5/18* (2013.01); *F23Q 9/08* (2013.01); *F23Q 13/02* (2013.01); *F23C 5/08* (2013.01); *F23C 2201/20* (2013.01); *F23D 2207/00* (2013.01); *F23D 2209/20* (2013.01); *F23D 2900/00014* (2013.01); *F23D 2900/00015* (2013.01); *F23N 2023/00* (2013.01); *F23N 2029/00* (2013.01); *F23N 2037/00* (2013.01)

(58) Field of Classification Search

CPC ..... F23C 5/02; F23C 5/08; F23N 5/18; F23N 2037/02; F23N 2037/04; F23D 2207/00; F23D 2209/20; F23D 2209/00; F23D 2900/00014; F23D 11/42; F23D 14/72

USPC ..... 431/6, 60

See application file for complete search history.

(56) References Cited

U.S. PATENT DOCUMENTS

| | | | | |
|---|---|---|---|---|
| 3,076,605 | A | 2/1963 | Holden | |
| 3,167,109 | A | 1/1965 | Wobig | |
| 3,224,485 | A | 12/1965 | Blomgren, Sr. et al. | |
| 3,269,446 | A | 8/1966 | Luther | |
| 3,358,731 | A | 12/1967 | Donnelly | |
| 3,416,870 | A | 12/1968 | Wright | |
| 3,749,545 | A | 7/1973 | Velkoff | |
| 3,841,824 | A | 10/1974 | Bethel | |
| 3,887,325 | A * | 6/1975 | Finger | F23N 5/02 122/14.21 |
| 4,020,388 | A | 4/1977 | Pratt, Jr. | |
| 4,021,188 | A | 5/1977 | Yamagishi et al. | |
| 4,091,779 | A | 5/1978 | Suafferer et al. | |
| 4,111,636 | A | 9/1978 | Goldberg | |
| 4,230,448 | A * | 10/1980 | Ward | F23C 99/001 123/434 |
| 4,408,461 | A | 10/1983 | Bruhwiler et al. | |
| 4,430,024 | A | 2/1984 | Guild et al. | |
| 4,588,373 | A | 5/1986 | Tonon et al. | |
| 4,643,667 | A | 2/1987 | Fleming | |
| 4,673,349 | A | 6/1987 | Abe et al. | |
| 4,726,767 | A | 2/1988 | Nakajima | |
| 5,088,917 | A | 2/1992 | Leleu et al. | |
| 5,235,667 | A | 8/1993 | Canfield et al. | |
| 5,326,257 | A | 7/1994 | Taylor et al. | |
| 5,441,402 | A | 8/1995 | Reuther et al. | |
| 5,498,154 | A | 3/1996 | Velie et al. | |
| 5,515,681 | A | 5/1996 | DeFreitas | |
| 5,551,869 | A * | 9/1996 | Brais | F23D 14/70 431/278 |
| 5,577,905 | A | 11/1996 | Momber et al. | |
| 5,654,868 | A | 8/1997 | Buer | |
| 5,667,374 | A | 9/1997 | Nutcher et al. | |
| 5,702,244 | A | 12/1997 | Goodson et al. | |
| 5,899,686 | A | 5/1999 | Carbone et al. | |
| 6,247,921 | B1 | 6/2001 | Helt | |
| 6,499,990 | B1 | 12/2002 | Zink et al. | |
| 6,997,701 | B2 | 2/2006 | Volkert et al. | |
| 7,137,808 | B2 | 11/2006 | Branston et al. | |
| 7,243,496 | B2 | 7/2007 | Pavlik et al. | |
| 7,360,506 | B2 | 4/2008 | Shellenberger et al. | |
| 7,845,937 | B2 | 12/2010 | Hammer et al. | |
| 7,944,678 | B2 | 5/2011 | Kaplan et al. | |
| 8,245,951 | B2 | 8/2012 | Fink et al. | |
| 8,851,882 | B2 | 10/2014 | Hartwick et al. | |
| 8,881,535 | B2 | 11/2014 | Hartwick et al. | |
| 8,911,699 | B2 | 12/2014 | Colannino et al. | |
| 9,151,549 | B2 | 10/2015 | Goodson et al. | |
| 9,209,654 | B2 | 12/2015 | Colannino et al. | |
| 9,243,800 | B2 | 1/2016 | Goodson et al. | |
| 9,267,680 | B2 | 2/2016 | Goodson et al. | |
| 9,284,886 | B2 | 3/2016 | Breidenthal et al. | |
| 9,289,780 | B2 | 3/2016 | Goodson | |
| 9,310,077 | B2 | 4/2016 | Breidenthal et al. | |
| 9,366,427 | B2 | 6/2016 | Sonnichsen et al. | |
| 9,371,994 | B2 | 6/2016 | Goodson et al. | |
| 9,377,188 | B2 | 6/2016 | Ruiz et al. | |
| 9,377,189 | B2 | 6/2016 | Ruiz et al. | |
| 9,377,190 | B2 | 6/2016 | Karkow et al. | |
| 9,388,981 | B2 | 7/2016 | Karkow et al. | |
| 9,441,834 | B2 | 9/2016 | Colannino et al. | |
| 9,447,965 | B2 | 9/2016 | Karkow et al. | |
| 9,453,640 | B2 | 9/2016 | Krichtafovitch et al. | |
| 2003/0054313 | A1 | 3/2003 | Rattner et al. | |
| 2005/0208442 | A1 | 9/2005 | Heiligers et al. | |
| 2006/0165555 | A1 | 7/2006 | Spielman et al. | |
| 2007/0020567 | A1 | 1/2007 | Branston et al. | |
| 2007/0044449 | A1 | 3/2007 | O'Brien et al. | |
| 2010/0178219 | A1 | 7/2010 | Verykios et al. | |
| 2011/0072786 | A1 | 3/2011 | Tokuda et al. | |
| 2011/0076628 | A1 | 3/2011 | Miura et al. | |
| 2012/0231398 | A1 | 9/2012 | Carpentier et al. | |
| 2013/0071794 | A1 | 3/2013 | Colannino et al. | |
| 2013/0230810 | A1 | 9/2013 | Goodson et al. | |
| 2013/0230811 | A1 | 9/2013 | Goodson et al. | |
| 2013/0260321 | A1 | 10/2013 | Colannino et al. | |
| 2013/0291552 | A1 | 11/2013 | Smith et al. | |
| 2013/0323661 | A1 | 12/2013 | Goodson et al. | |
| 2013/0333279 | A1 | 12/2013 | Osler et al. | |
| 2013/0336352 | A1 | 12/2013 | Colannino et al. | |
| 2014/0051030 | A1 | 2/2014 | Colannino et al. | |
| 2014/0065558 | A1 | 3/2014 | Colannino et al. | |
| 2014/0076212 | A1 | 3/2014 | Goodson et al. | |
| 2014/0080070 | A1 | 3/2014 | Krichtafovitch et al. | |
| 2014/0162195 | A1 | 6/2014 | Lee et al. | |
| 2014/0162196 | A1 | 6/2014 | Krichtafovitch et al. | |
| 2014/0162197 | A1 | 6/2014 | Krichtafovitch et al. | |
| 2014/0162198 | A1 | 6/2014 | Krichtafovitch et al. | |
| 2014/0170569 | A1 | 6/2014 | Anderson et al. | |
| 2014/0170571 | A1 | 6/2014 | Casasanta, III et al. | |
| 2014/0170575 | A1 | 6/2014 | Krichtafovitch | |
| 2014/0170576 | A1 | 6/2014 | Colannino et al. | |
| 2014/0170577 | A1 | 6/2014 | Colannino et al. | |
| 2014/0196368 | A1 | 7/2014 | Wiklof | |
| 2014/0196369 | A1 | 7/2014 | Wiklof | |
| 2014/0208758 | A1 | 7/2014 | Breidenthal et al. | |
| 2014/0212820 | A1 | 7/2014 | Colannino et al. | |
| 2014/0216401 | A1 | 8/2014 | Colannino et al. | |
| 2014/0227645 | A1 | 8/2014 | Krichtafovitch et al. | |
| 2014/0227646 | A1 | 8/2014 | Krichtafovitch et al. | |
| 2014/0227649 | A1 | 8/2014 | Krichtafovitch et al. | |
| 2014/0248566 | A1 | 9/2014 | Krichtafovitch et al. | |
| 2014/0255855 | A1 | 9/2014 | Krichtafovitch | |
| 2014/0255856 | A1 | 9/2014 | Colannino et al. | |
| 2014/0272731 | A1 | 9/2014 | Breidenthal et al. | |
| 2014/0287368 | A1 | 9/2014 | Krichtafovitch et al. | |
| 2014/0295094 | A1 | 10/2014 | Casasanta, III | |
| 2014/0295360 | A1 | 10/2014 | Wiklof | |
| 2014/0335460 | A1 | 11/2014 | Wiklof et al. | |
| 2015/0079524 | A1 | 3/2015 | Colannino et al. | |
| 2015/0104748 | A1 | 4/2015 | Dumas et al. | |
| 2015/0107260 | A1 | 4/2015 | Colannino et al. | |
| 2015/0118629 | A1 | 4/2015 | Colannino et al. | |
| 2015/0121890 | A1 | 5/2015 | Colannino et al. | |
| 2015/0140498 | A1 | 5/2015 | Colannino | |
| 2015/0147704 | A1 | 5/2015 | Krichtafovitch et al. | |
| 2015/0147705 | A1 | 5/2015 | Colannino et al. | |
| 2015/0147706 | A1 | 5/2015 | Krichtafovitch et al. | |
| 2015/0219333 | A1 | 8/2015 | Colannino et al. | |
| 2015/0226424 | A1 | 8/2015 | Breidenthal et al. | |

(56) References Cited

U.S. PATENT DOCUMENTS

| | | | |
|---|---|---|---|
| 2015/0241057 | A1 | 8/2015 | Krichtafovitch et al. |
| 2015/0276211 | A1 | 10/2015 | Colannino et al. |
| 2015/0276217 | A1 | 10/2015 | Karkow et al. |
| 2015/0285491 | A1 | 10/2015 | Karkow et al. |
| 2015/0316261 | A1 | 11/2015 | Karkow et al. |
| 2015/0330625 | A1 | 11/2015 | Karkow et al. |
| 2015/0338089 | A1 | 11/2015 | Krichtafovitch et al. |
| 2015/0345780 | A1 | 12/2015 | Krichtafovitch |
| 2015/0345781 | A1 | 12/2015 | Krichtafovitch et al. |
| 2015/0362177 | A1 | 12/2015 | Krichtafovitch et al. |
| 2015/0362178 | A1 | 12/2015 | Karkow et al. |
| 2015/0369476 | A1 | 12/2015 | Wiklof |
| 2015/0369477 | A1 | 12/2015 | Karkow et al. |
| 2016/0003471 | A1 | 1/2016 | Karkow et al. |
| 2016/0018103 | A1 | 1/2016 | Karkow et al. |
| 2016/0025333 | A1 | 1/2016 | Karkow et al. |
| 2016/0025374 | A1 | 1/2016 | Karkow et al. |
| 2016/0025380 | A1 | 1/2016 | Karkow et al. |
| 2016/0033125 | A1 | 2/2016 | Krichtafovitch et al. |
| 2016/0040872 | A1 | 2/2016 | Colannino et al. |
| 2016/0046524 | A1 | 2/2016 | Colannino et al. |
| 2016/0047542 | A1 | 2/2016 | Wiklof et al. |
| 2016/0091200 | A1 | 3/2016 | Colannino et al. |
| 2016/0109118 | A1 | 4/2016 | Krichtafovitch et al. |
| 2016/0123576 | A1 | 5/2016 | Colannino et al. |
| 2016/0123577 | A1 | 5/2016 | Dumas et al. |
| 2016/0138800 | A1 | 5/2016 | Anderson et al. |
| 2016/0161110 | A1 | 6/2016 | Krichtafovitch et al. |
| 2016/0161115 | A1 | 6/2016 | Krichtafovitch et al. |
| 2016/0215974 | A1 | 7/2016 | Wiklof |
| 2016/0230984 | A1 | 8/2016 | Colannino et al. |
| 2016/0245507 | A1 | 8/2016 | Goodson et al. |
| 2016/0273763 | A1 | 9/2016 | Colannino et al. |
| 2016/0273764 | A1 | 9/2016 | Colannino et al. |
| 2016/0298840 | A1 | 10/2016 | Karkow et al. |
| 2017/0261201 | A1* | 9/2017 | Goodson ..... F23C 99/001 |

FOREIGN PATENT DOCUMENTS

| | | |
|---|---|---|
| FR | 2577304 | 12/1989 |
| GB | 1042014 | 9/1966 |
| JP | 58-019609 | 2/1983 |
| JP | 60-155808 | 8/1985 |
| JP | 60-216111 | 10/1985 |
| JP | 61-265404 | 11/1986 |
| JP | 2001-021110 | 1/2001 |
| WO | WO 1995/000803 | 1/1995 |
| WO | WO 2013/181569 | 12/2013 |
| WO | WO 2015/017084 | 2/2015 |
| WO | WO 2015/042615 | 3/2015 |
| WO | WO 2015/051136 | 4/2015 |
| WO | WO 2015/054323 | 4/2015 |
| WO | WO 2015/057740 | 4/2015 |
| WO | WO 2015/061760 | 4/2015 |
| WO | WO 2015/089306 | 6/2015 |
| WO | WO 2015/103436 | 7/2015 |
| WO | WO 2015/112950 | 7/2015 |
| WO | WO 2015/123149 | 8/2015 |
| WO | WO 2015/123381 | 8/2015 |
| WO | WO 2015/123670 | 8/2015 |
| WO | WO 2015/123683 | 8/2015 |
| WO | WO 2015/123694 | 8/2015 |
| WO | WO 2015/123696 | 8/2015 |
| WO | WO 2015/123701 | 8/2015 |
| WO | WO 2016/003883 | 1/2016 |
| WO | WO 2016/007564 | 1/2016 |
| WO | WO 2016/018610 | 2/2016 |

OTHER PUBLICATIONS

James Lawton and Felix J. Weinberg. "Electrical Aspects of Combustion." Clarendon Press, Oxford. 1969, p. 81.

Arnold Schwarzenegger, "A Low NOx Porous Ceramics Burner Performance Study," California Energy Commission Public Interest Energy Research Program, Dec. 2007, San Diego State University Foundation, p. 5.

M. Zake et al., "Electric Field Control of NOx Formation in the Flame Channel Flows." Global Nest: The Int. J. May 2000, vol. 2, No. 1, pp. 99-108.

PCT International Search Report and Written Opinion of International PCT Application No. PCT/US2014/064892 dated Mar. 12, 2015.

* cited by examiner

COMBUSTION SYSTEM WITH FLAME LOCATION ACTUATION

CROSS REFERENCE TO RELATED APPLICATIONS

The present application is a U.S. National Phase application under 35 U.S.C. § 371 of co-pending International Patent Application No. PCT/US2014/064892, entitled "COMBUSTION SYSTEM WITH FLAME LOCATION ACTUATION," filed Nov. 10, 2014, co-pending herewith; which application claims priority benefit from U.S. Provisional Patent Application No. 61/901,746, entitled "COMBUSTION SYSTEM WITH FLAME LOCATION ACTUATION," filed Nov. 8, 2013; each of which, to the extent not inconsistent with the disclosure herein, is incorporated herein by reference.

SUMMARY

According to an embodiment, a combustion system with flame location control includes a fuel nozzle configured to output a fuel stream. An igniter is configured to selectably support an igniter flame proximate to a path corresponding to the fuel stream to cause the fuel stream to support a combustion reaction at a first flame location corresponding to the igniter flame. The igniter can cause the combustion reaction to be supported at the first location (e.g., during a first time interval) or not cause the combustion reaction to be supported at the first location (e.g., during a second time interval). For example, the combustion reaction can be supported at the first location during a warm-up phase of heating cycle and/or depending on operating conditions of the combustion system. A distal flame holder is configured to hold a combustion reaction at a second flame location when the igniter does not cause the combustion reaction at the first location.

According to another embodiment, a combustion system includes a fuel nozzle configured to emit a main fuel stream along a fuel stream path and a distal flame holder positioned to subtend the fuel stream path a second distance from the fuel nozzle. The distal flame holder is configured to hold a distal combustion reaction supported by the main fuel stream emitted from the fuel nozzle when the distal flame holder is heated to an operating temperature. An igniter is configured to selectively support an igniter flame positioned to ignite the main fuel stream to maintain ignition of a preheat flame between the nozzle and the distal flame holder at a first distance less than the second distance from the nozzle. The preheat flame raises the temperature of the distal flame holder to the operating temperature. An igniter actuator is configured to cause the igniter not to ignite the main fuel stream after the distal flame holder is heated to the operating temperature.

According to an embodiment, a combustion igniter system includes an igniter flame nozzle configured to support an igniter flame in a combustion ignition position and an igniter flame actuator configured to deflect the igniter flame between a first igniter flame position, and a second igniter flame position. Actuation of the igniter flame causes the combustion igniter system to either ignite a main fuel stream or to not ignite the main fuel stream. Igniting the main fuel stream causes a preheat flame to burn at the combustion ignition position.

According to an embodiment, a method of operating a combustion system includes emitting, from a fuel nozzle, a main fuel stream toward a distal flame holder, preheating the distal flame holder by supporting an igniter flame in a position to fully ignite the main fuel stream and to hold a resulting preheat flame between the fuel nozzle and the distal flame holder, and igniting a distal combustion reaction at the distal flame holder once the distal flame holder has reached an operating temperature. The method can include keeping the igniter flame burning at least until the distal combustion reaction is ignited. Igniting the distal combustion reaction includes causing at least a portion of the main fuel stream to pass the igniter flame position without igniting.

BRIEF DESCRIPTION OF THE DRAWINGS

Many of the drawings of the present disclosure are schematic diagrams, and thus are not intended to accurately show the relative positions or orientation of elements depicted, except to the extent that such relationships are explicitly defined in the specification. Instead, the drawings are intended to illustrate the functional interactions of the elements.

DETAILED DESCRIPTION

Figure 1A:
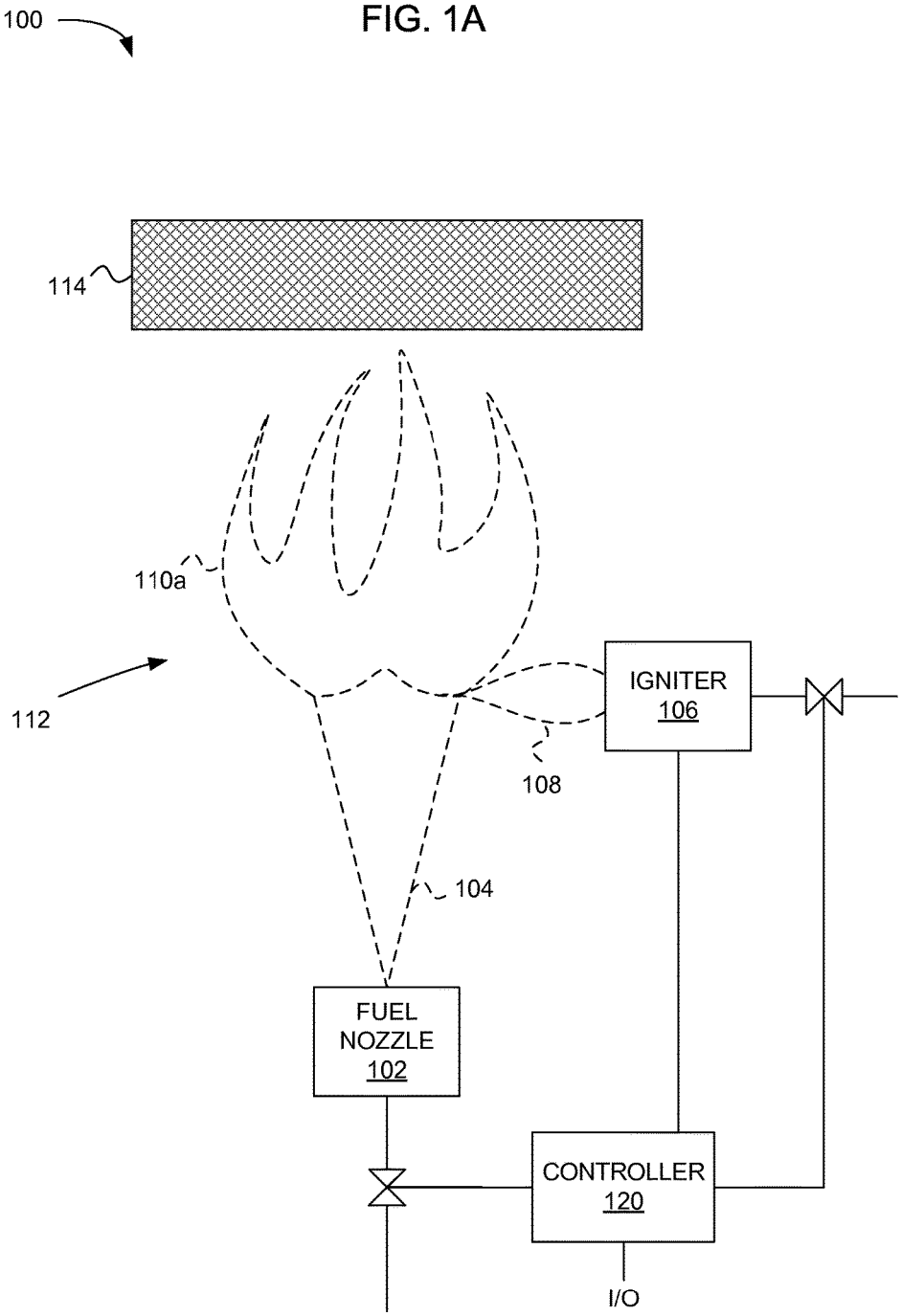
FIG. 1A is a diagram of a combustion system with selectable ignition location, wherein a combustion reaction is ignited at a first location, according to an embodiment.
Figure 1B:
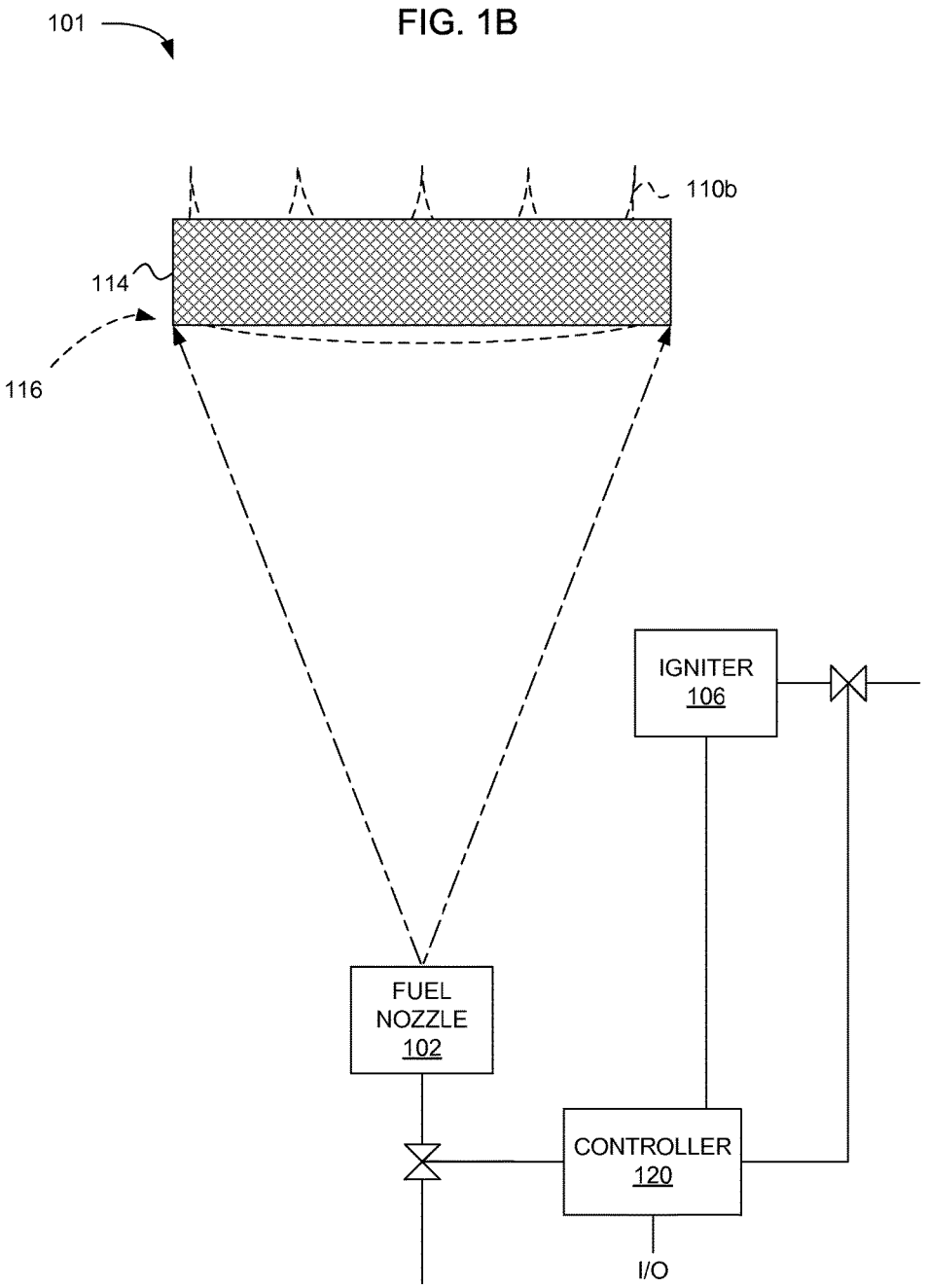
FIG. 1B is a diagram of a combustion system with selectable ignition location, wherein a combustion reaction is ignited at a second location, according to an embodiment.

In the following detailed description, reference is made to the accompanying drawings, which form a part hereof. In the drawings, similar symbols typically identify similar components, unless context dictates otherwise. Other embodiments may be used and/or other changes may be made without departing from the spirit or scope of the disclosure FIG. 1A is a diagram of a combustion system 100 with selectable ignition location, wherein a combustion reaction 110*a* is ignited at a first location 112, according to an embodiment. FIG. 1B is a diagram of a combustion system 101 with selectable ignition location, wherein a combustion reaction 110*b* is ignited at a second location 116, according to an embodiment. The combustion system 100 with flame location control includes a fuel nozzle 102 configured to output a fuel stream 104. An igniter 106 is configured to selectably support an igniter flame 108 proximate to a path corresponding to the fuel stream 104 to cause the fuel stream 104 to support a combustion reaction 110*a* at the first flame location 112 corresponding to the igniter flame 108 during a first time interval. A distal flame holder 114 is configured to hold a combustion reaction 110*b* at a second flame location 116 defined by the distal flame holder 114 during a second time interval, different than the first time interval, during which the igniter 106 does not support the igniter flame 108.

The first location 112 can be selected to cause the combustion reaction 110*a* to apply heat to the distal flame holder 114. Raising the temperature of the distal flame holder 114 causes the distal flame holder 114 to maintain reliable combustion. Within an allowable range of fuel flow rates, after being heated by the combustion reaction 110*a* at the first location 112, the distal flame holder 114 receives sufficient heat from the combustion reaction 110*b* at the second location 116 to reliably maintain the combustion reaction 110*b*. The combustion system 100 can be configured to cause the combustion reaction 110*a* to be held at the first location 112 during a first time interval corresponding to system start-up, for example.

The first flame location 112 can be selected to correspond to a stable flame 110*a* that is relatively rich compared to a lean flame corresponding to the second flame location 116. The second flame location 116 can be selected to correspond to a low NOx flame that is relatively lean compared to the first flame location 112. The fuel stream 104 becomes increasingly dilute as it travels away from the fuel nozzle 102. A leaner combustion reaction 110*b* at a more distal (second) location 116 is cooler than a richer combustion reaction 110*a* at a more proximal (first) location 112. The cooler combustion reaction 110*b* at the more distal (second) location 116 outputs reduced NOx than a hotter combustion reaction 110*a* at the more proximal (first) location 112. However, the cooler combustion reaction 110*b* is generally less stable than the hotter combustion reaction 110*a*. To reliably maintain the second combustion reaction 110*b*, the distal flame holder 114 acts both as a heat sink that receives heat from the second combustion reaction 110*b* and as a heat source that supplies heat to the second combustion reaction 110*b*. This function of the distal flame holder 114 structure was found to reliably maintain the relatively lean and cool combustion reaction 110*b*. In order for the distal flame holder 114 to reliably maintain the combustion reaction 110*b*, the distal flame holder 114 is first heated to a sufficiently high temperature to perform the heat source function. The "sufficiently high temperature" (to maintain combustion) may also be referred to as an operating temperature." The selectable igniter 106 causes the combustion reaction 110*a* to be held at the first location 112 to cause the combustion reaction 110*a* to supply heat to the distal flame holder 114.

The first time interval, when the combustion reaction 110*a* is held at the first location 112 can correspond to a start-up cycle of the combustion system 100, can correspond to a transition to or from a high heat output second time interval, and/or can correspond to a recovery from a fault condition, for example.

Figure 1C:
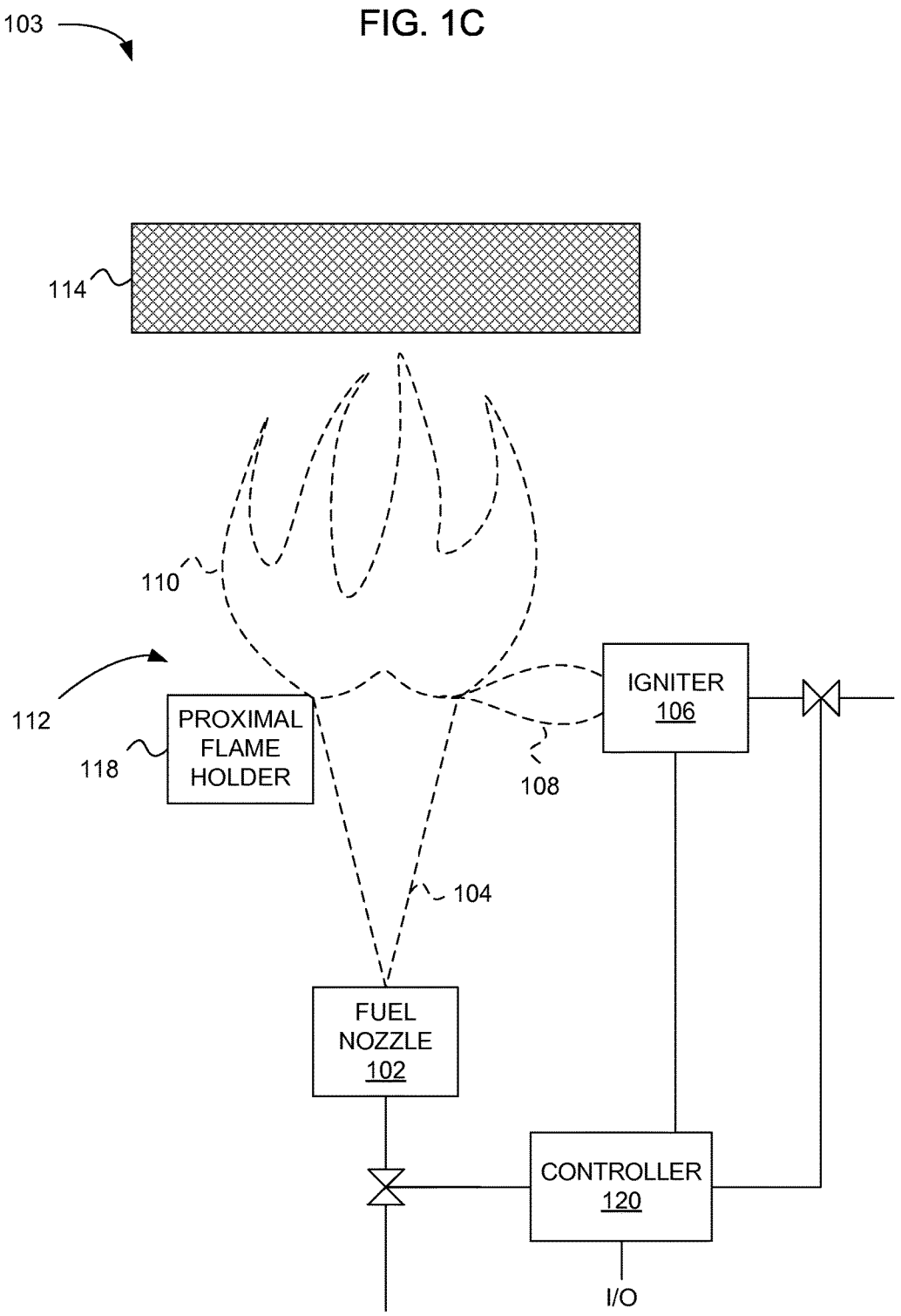
FIG. 1C is a diagram of a combustion system with selectable ignition location, wherein a combustion reaction is ignited at a first location corresponding to a proximal flame holder, according to an embodiment.

FIG. 1C is a diagram of a combustion system 103 with selectable ignition location, wherein a combustion reaction 110 is ignited at a first location 112 corresponding to a proximal flame holder 118, according to an embodiment. The proximal physical flame holder 118 can be disposed adjacent to a path of the fuel stream 104 and configured to cooperate with the igniter 106 to cause the combustion reaction 110 to be held at the first flame location 112. The proximal flame holder 118 can include a bluff body and a flame holding electrode held at a voltage different than a voltage applied to the combustion reaction 110 during the first time interval.

Figure 3:
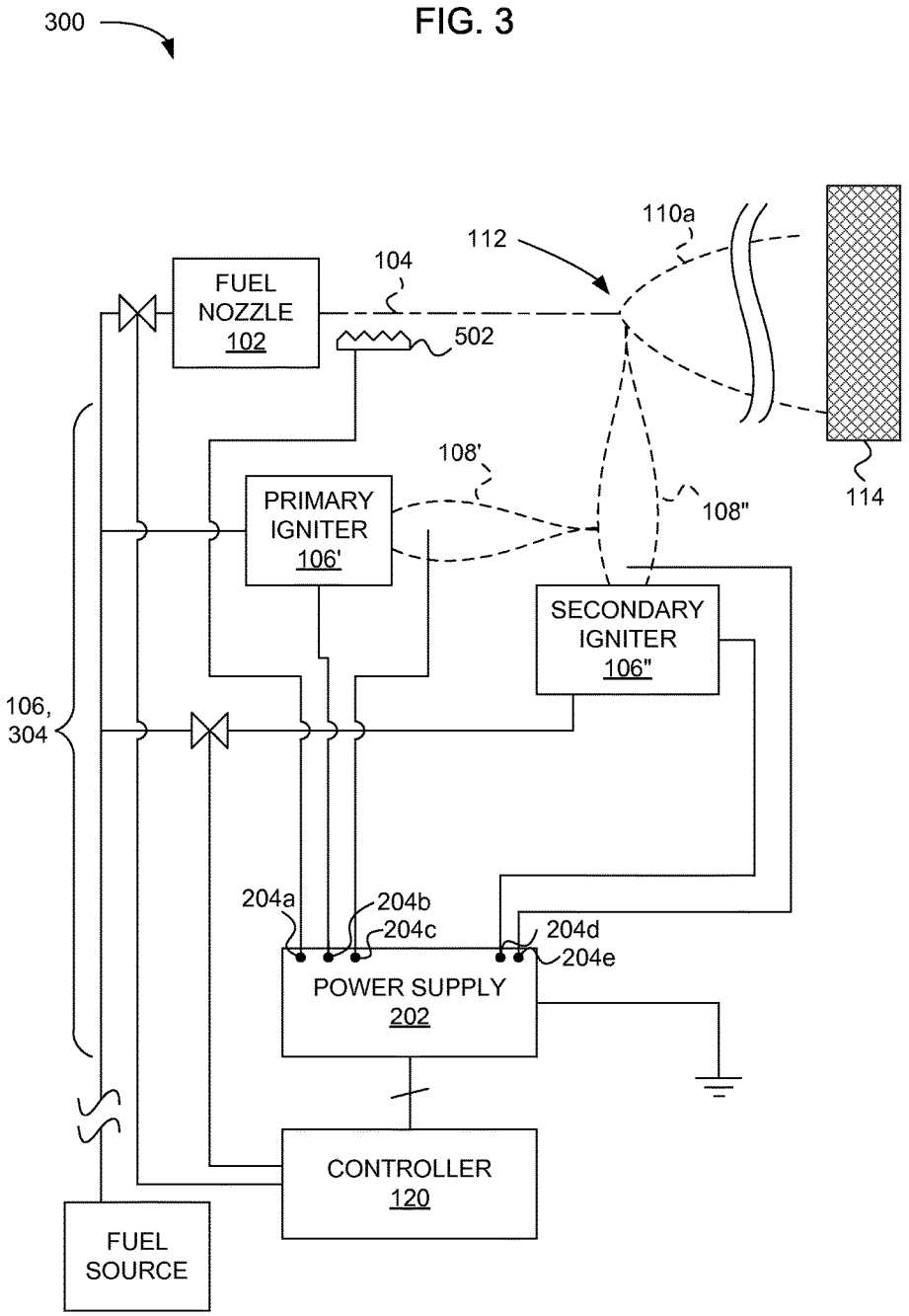
FIG. 3 is a diagram of a combustion system with selectable ignition location, wherein a combustion reaction is ignited at a first location by a cascade of flame igniters, according to an embodiment.
Figure 5A:
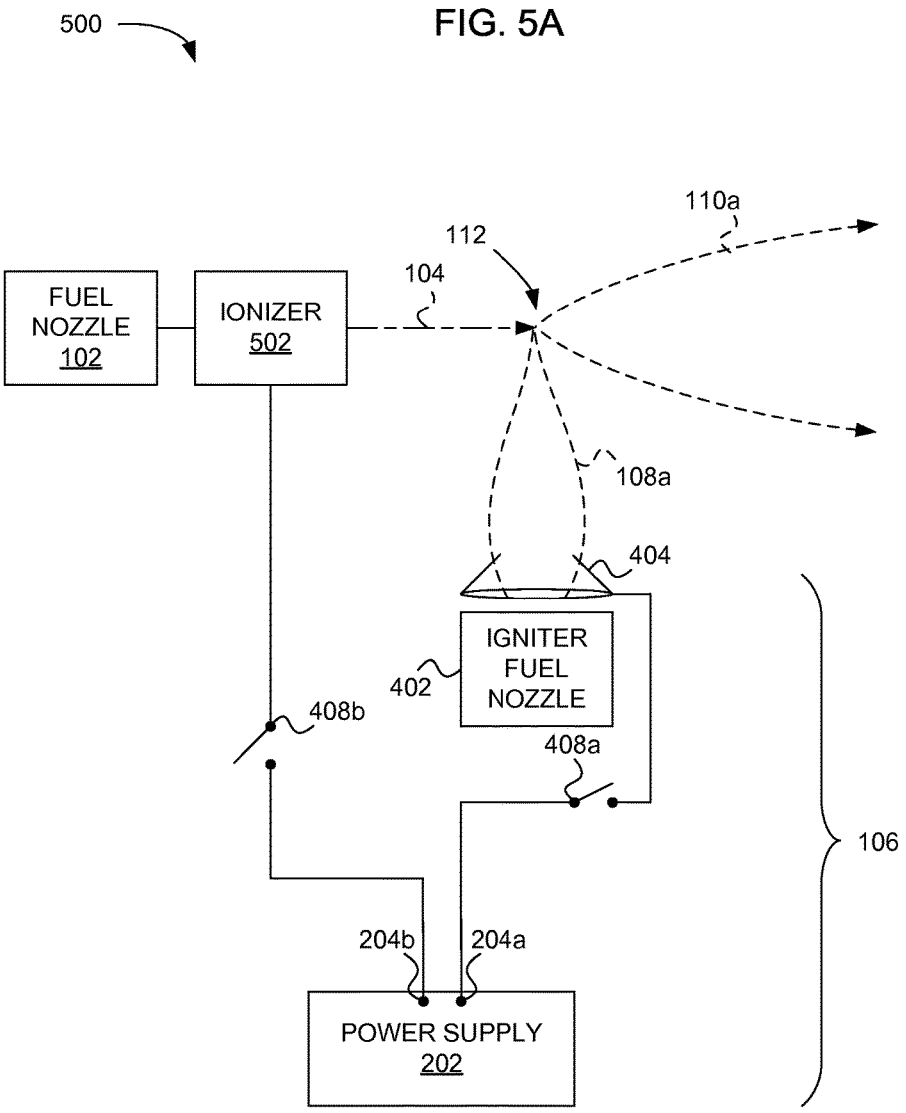
FIG. 5A is a diagram of a combustion system with selectable ignition location, wherein a combustion reaction is ignited at a first location by a deflectable ignition flame, according to an embodiment.
Figure 5B:
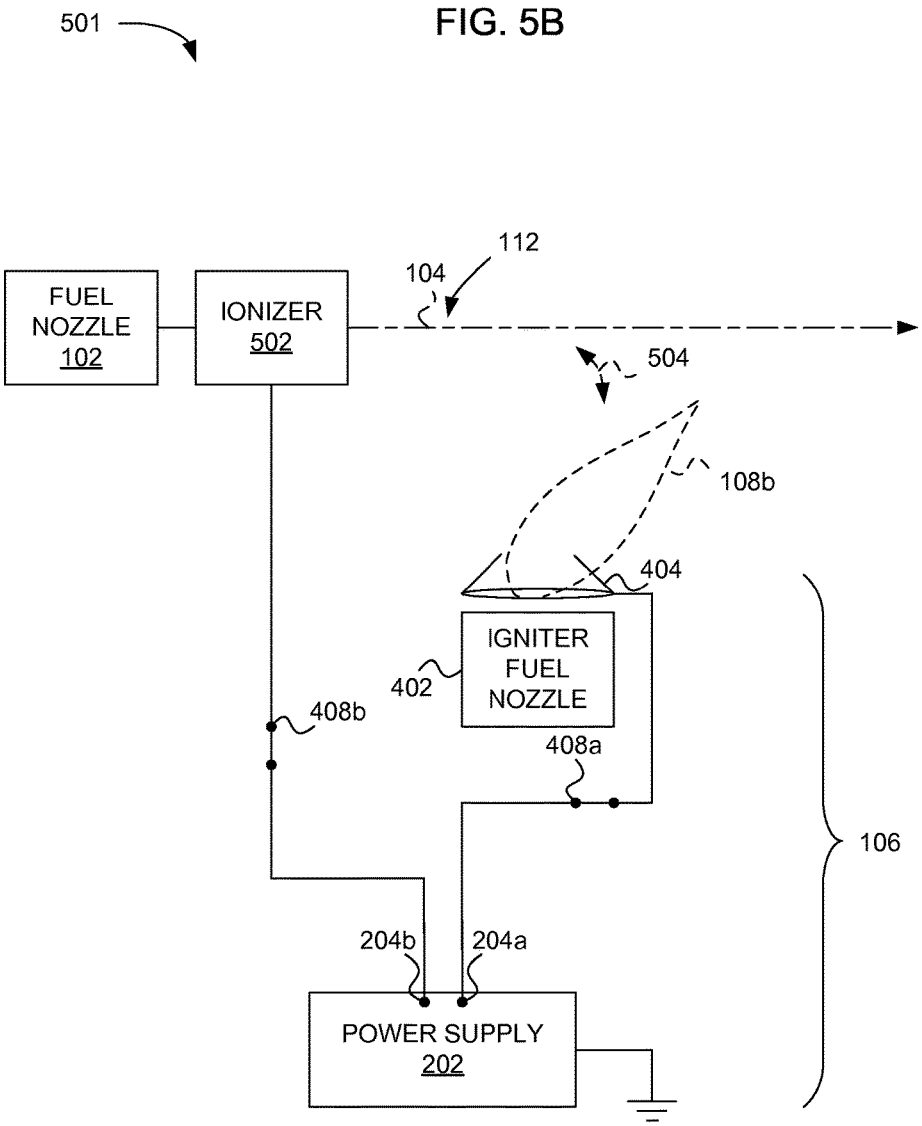
FIG. 5B is a diagram of a combustion system, similar to the system of FIG. 5A, wherein a combustion reaction is not ignited at a first location by the deflectable ignition flame, according to an embodiment.

Referring now to FIGS. 3, 5A, 5B, the combustion system 100 can optionally include a combustion reaction charge assembly 502 configured to apply a voltage to the combustion reaction 110*a* during at least the first time interval. The combustion reaction charge assembly 502 can include a corona electrode configured to output charged particles at a location selected to cause the charged particles to exist in the combustion reaction 110*a* (thus creating the voltage applied to the combustion reaction 110*a*) during at least the first time interval. The combustion reaction charge assembly 502 can include an ionizer configured to output charged particles at a location selected to cause the charged particles to exist in the combustion reaction 110*a* (thus creating the voltage applied to the combustion reaction 110*a*) during at least the first time interval. The combustion reaction charge assembly 502 can include a charge rod configured to carry the voltage to the combustion reaction 110*a* during at least the first time interval.

Wherein the combustion system 100 does not include a proximal flame holder 118 disposed adjacent to the fuel stream 104, the igniter 106 can be configured to cooperate with the fuel nozzle 102 to cause the combustion reaction 110*a* to be held in the fuel stream 104 at the first flame location 112.

Referring to FIGS. 1A-1C, a controller 120 can be operatively coupled to the igniter 106 configured to receive a first control signal from the controller 120 and responsively apply a first voltage state to the igniter flame 108, the first voltage state being selected to cause the igniter flame 108 to ignite the fuel stream 104 at the first location 112 (as shown in FIG. 1A). Additionally or alternatively, the controller 120 can be operatively coupled to the igniter 106 configured to receive a second control signal from the controller 120 and responsively apply a second voltage state to the igniter flame 108, the second voltage state being selected to cause the igniter flame 108 to not ignite the fuel stream 104 at the first location 112 (as shown in FIGS. 1B and 1C).

Figure 2:
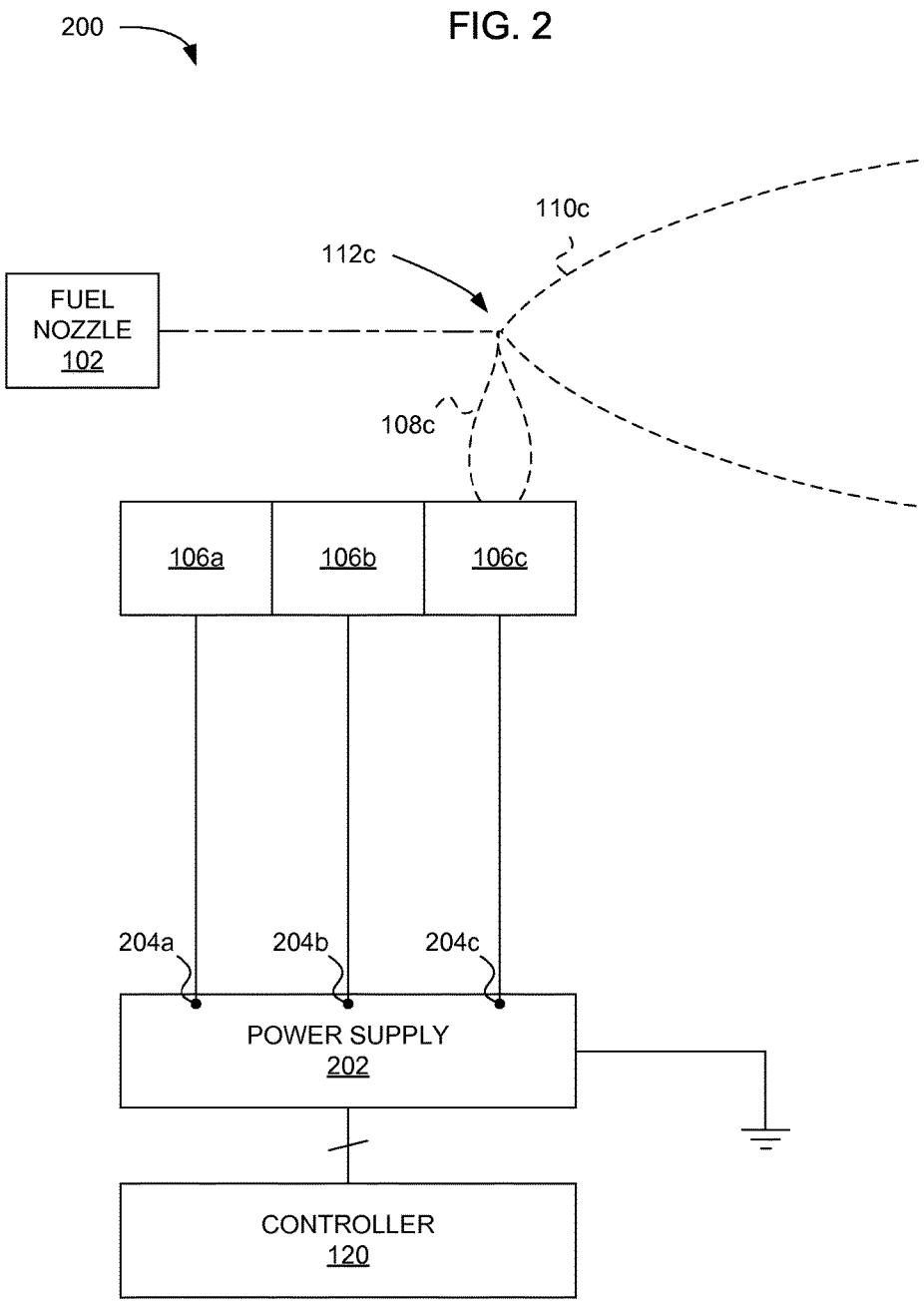
FIG. 2 is a diagram of a combustion system with selectable ignition location, wherein a combustion reaction is ignited at one of a plurality of locations, according to an embodiment.

FIG. 2 is a diagram of a combustion system 200 with selectable ignition location, wherein a combustion reaction is ignited at one of a plurality of locations, according to an embodiment. The igniter 106 can include an array of igniters 106*a-c* configured to selectably cause the combustion reaction 110*c* to be held at a location 112*c*. A controller 120 can be configured to output one or more control signals. The igniter 106 can include a power supply 202 operatively coupled to the controller 120, and configured to output a high voltage on one or more electrical nodes 204*a*, 204*b*, 204*c* responsive to the control signal from the controller 120. At least one igniter 106*a*, 106*b*, 106*c* can be operatively coupled to the power supply 202 and configured to selectively project an ignition flame 108*c* to cause ignition of a combustion reaction 110*c* responsive to receipt of a high voltage from at least one of the electrical nodes 204*a*, 204*b*, 204*c*.

FIG. 3 is a diagram of a combustion system 300 including a cascaded igniter 304, according to an embodiment. As shown in FIG. 3, combustion systems disclosed herein can be used in plural staged ignition systems. The structure and function used to cause selective ignition of the secondary ignition flame 108" and the combustion reaction 110*a* is described in more detail in FIG. 5 below.

Referring to FIG. 3, the igniter 106 can include a cascaded igniter 304, the cascaded igniter 304 including a primary igniter 106' configured to selectively ignite a secondary igniter 106", and the secondary igniter 106" being configured to selectively ignite the fuel stream 104 to cause the combustion reaction 110*a* to be held at the first location 112.

The igniter 106 can include a power supply 202 operatively coupled to a controller 120, and configured to output a high voltage on one or more electrical nodes 204*a*, 204*b*, 204*c*, 204*d*, and 204*e* responsive to a control signal from the controller 120. At least one igniter 106', 106" can be operatively coupled to the power supply 202 and configured to selectively project an ignition flame 108', 108" to cause ignition of a combustion reaction 110*a* responsive to receipt of a high voltage from at least one of the electrical nodes 204*a*, 204*b*, 204*c*, 204*d*, and 204*e*.

Figure 4A:
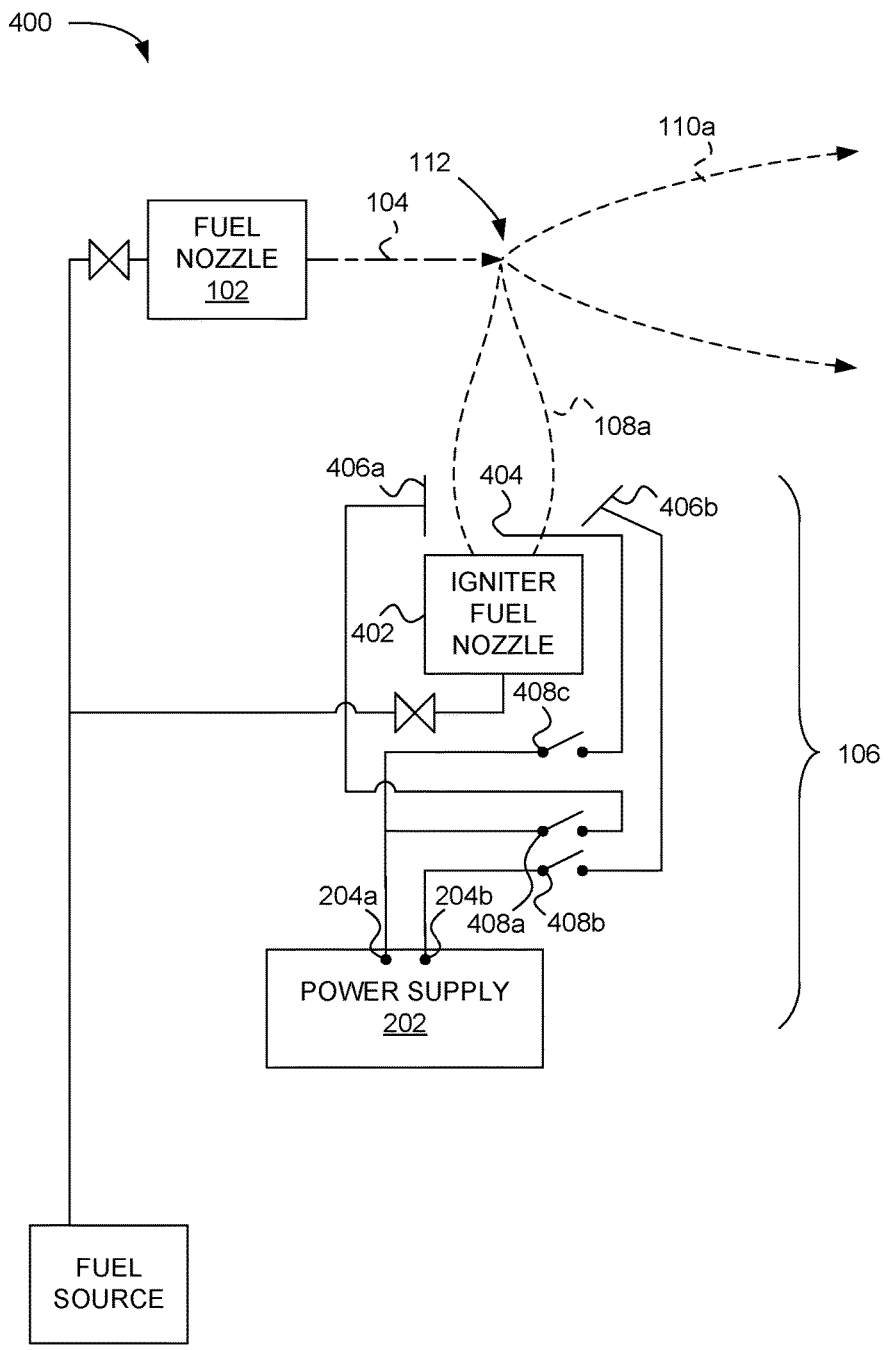
FIG. 4A is a diagram of a combustion system with selectable ignition location, wherein a combustion reaction is ignited at a first location by a deflectable ignition flame, according to an embodiment.
Figure 4B:
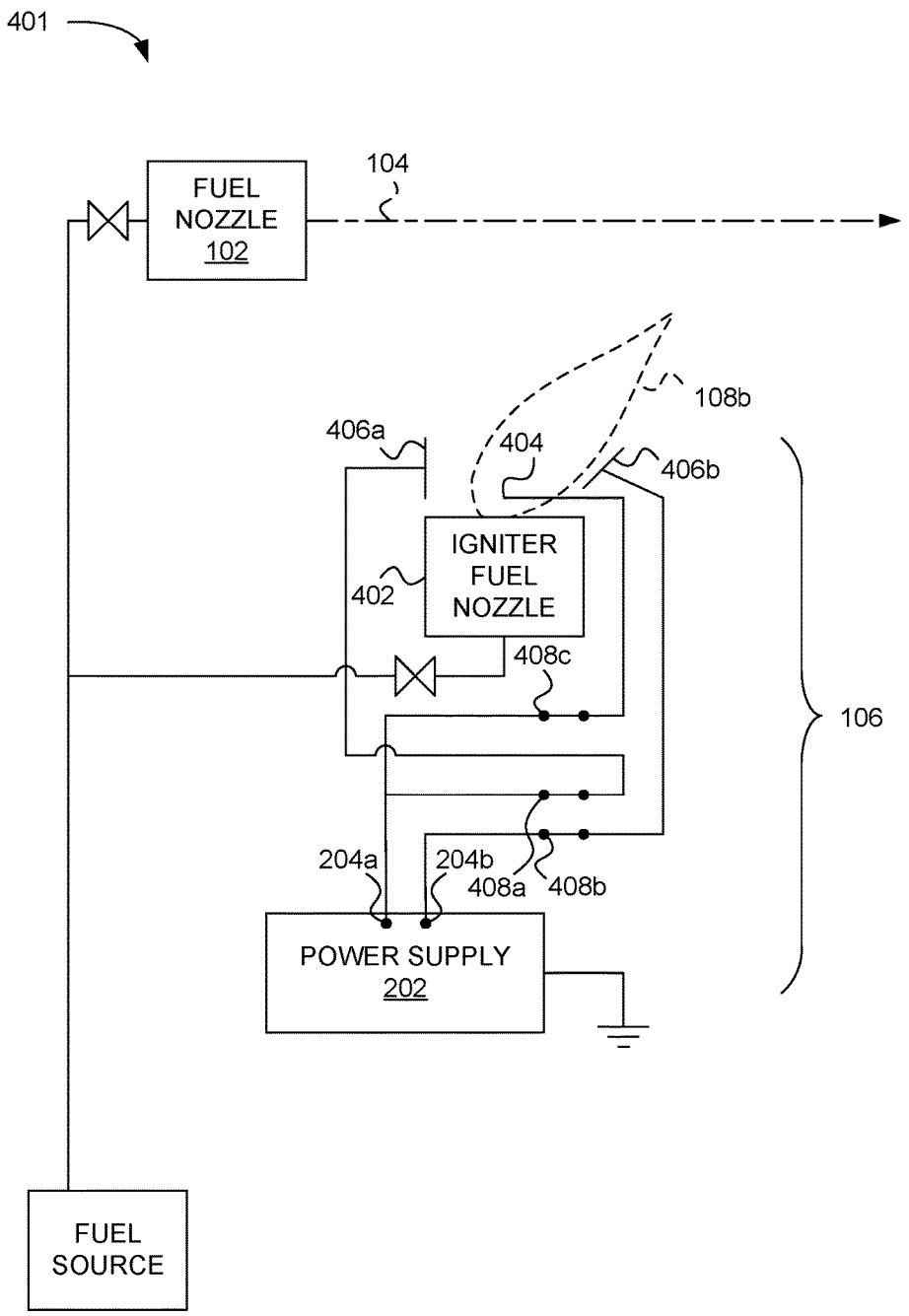
FIG. 4B is a diagram of a combustion system, similar to the system of FIG. 4A, wherein a combustion reaction is not ignited at the first location by the deflectable ignition flame, according to an embodiment.

FIG. 4A is a diagram of a combustion system 400 with selectable ignition location, wherein a combustion reaction 110*a* is ignited at a first location 112 by a deflectable ignition flame, according to an embodiment. FIG. 4B is a diagram of a combustion system 401, similar to the system 400 of FIG. 4A, wherein a combustion reaction 110*a* is not ignited at the first location 112 by the deflectable ignition flame, according to an embodiment. The igniter 106 can further include an igniter fuel nozzle 402 configured to support an ignition flame 108*a*, 108*b*. A high voltage power supply 202 can be configured to output a high voltage on at least one electrical node 204*a*, 204*b*. An ignition flame charging mechanism 404 can be operatively coupled to the high voltage power supply 202 and configured to apply an electric charge having a first polarity to the ignition flame 108*a*, 108*b* through switch 408*c*. At least one ignition flame deflection electrode 406*a*, 406*b* can be disposed to selectively apply an electric field across the ignition flame 108*a*, 108*b*. At least one switch 408*a*, 408*b* can be configured to selectively cause a high voltage from at least one electrical node 204*a*, 204*b* to be placed on the at least one ignition flame deflection electrode 406*a*, 406*b*.

The switch(es) 408*a*, 408*b* can be disposed to open or close electrical continuity between the electrical node(s) 204*a*, 204*b* and the ignition flame deflection electrode(s) 406*a*, 406*b* (as shown in FIGS. 4A, 4B). Additionally or alternatively, the switch(es) 408*a*, 408*b* can be disposed to open or close electrical continuity between a low voltage source and the power supply 202.

The ignition flame 108 can be configured for a non-deflected trajectory 108*b* such that the combustion reaction 110*a* is not ignited by the ignition flame 108 when the ignition flame 108 is not deflected. Additionally or alternatively, the ignition flame 108 can be configured for a non-deflected trajectory 108*b* such that the combustion reaction 110*a* is ignited at the first location 112 when the ignition flame is deflected. The ignition flame 108 can be configured for a non-deflected trajectory 108*a* such that the combustion reaction 110*a* is ignited at the first location 112, when the ignition flame is not deflected.

FIG. 5A is a diagram of a combustion system 500 with selectable ignition location, wherein a combustion reaction 110*a* is ignited at a first location 112 by a deflectable ignition flame 108*a*, according to an embodiment. FIG. 5B is a diagram of a combustion system 501, similar to the system 500 of FIG. 5A, wherein a combustion reaction 110*a* is not ignited at a first location 112 by the deflectable ignition flame, according to an embodiment. Referring to FIG. 5A and FIG. 5B, a combustion reaction charger 502 can be operatively coupled to the fuel nozzle 102, configured to apply a charge to the combustion reaction 110*a* or the fuel stream 104. The igniter 106 can further include an igniter fuel nozzle 402 configured to support an ignition flame 108*a*, 108*b*. A high voltage power supply 202 can be configured to output a high voltage on at least one electrical node 204*a*, 204*b*. An ignition flame charging mechanism 404 can be operatively coupled to the high voltage power supply 202 and configured to selectively apply an electric charge having a first polarity to the ignition flame 108*a*, 108*b*. The high voltage power supply 202 also can be operatively coupled to the combustion reaction charger 502. The igniter 106 can further include at least one switch 408*a*, 408*b* configured to selectively cause a high voltage from at least one electrical node 204*a*, 204*b* to be placed on the at least one of the ignition flame charging mechanism 404 or the combustion reaction charger 502.

Referring to FIG. 5A and FIG. 5B, the at least one switch 408*a* can be disposed to open or close electrical continuity between the electrical node 204*a* and the ignition flame charging mechanism 404. A second electrical node 204*b* can be held in continuity with the combustion reaction charger 502 and is not switched. A second switch 408*b* can be disposed to open or close electrical continuity between the electrical node 204*b* and the combustion reaction charger 502. Additionally or alternatively, at least one switch 408*a*, 408*b* can be disposed to open or close electrical continuity between a low voltage source and the power supply 202 (configuration not shown in FIGS. 5A, 5B).

The ignition flame 108 can be configured for a non-deflected trajectory 108*b* such that the combustion reaction 110*a* is not ignited by the ignition flame when the ignition flame is not deflected. Additionally or alternatively, the ignition flame 108 can be configured for a non-deflected trajectory 108*b* such that the combustion reaction 110*a* is ignited at the first location 112 when the ignition flame is deflected.

In an embodiment, the ignition flame 108 can be configured for a non-deflected trajectory 108*a* such that the combustion reaction 110*a* is ignited at the first location 112, when the ignition flame is not deflected. The combustion reaction charger 502 and the ignition flame charger can be configured to respectively charge the fuel stream 104 and the ignition flame 108*b* at the same polarity to cause electrostatic repulsion 504 between the fuel stream 104 and the ignition flame 180*b* to deflect the ignition flame to cause the combustion reaction 110*a* to not be ignited at the first location 112 (configuration shown in FIG. 5B).

According to an embodiment, at least one electrical node 204*a*, 204*b* can include two electrical nodes, and wherein the high voltage power supply 202 can be configured to output high voltages at opposite polarities to the first and second electrical nodes 204*a*, 204*b*. For example, the combustion reaction charger 502 can be configured to charge the fuel stream 104 or the combustion reaction 110*a* at a first polarity when the combustion reaction charger 502 receives a high voltage at the first polarity from the first electrical node 204*b* and the ignition flame charging mechanism 404 can be configured to charge the ignition flame 108*a* at a second polarity opposite to the first polarity when the ignition flame charging mechanism 404 receives a high voltage at the second polarity from the second electrical node 204*a*. The combustion reaction charger 502 and the ignition flame charging mechanism 404 can be respectively configured to charge the fuel stream 104 and the ignition flame 108*a* at opposite polarities to cause the ignition flame 108*a* to be electrostatically attracted to the fuel stream 104 to ignite the fuel stream 104 at the first location 112.

Figure 6A:
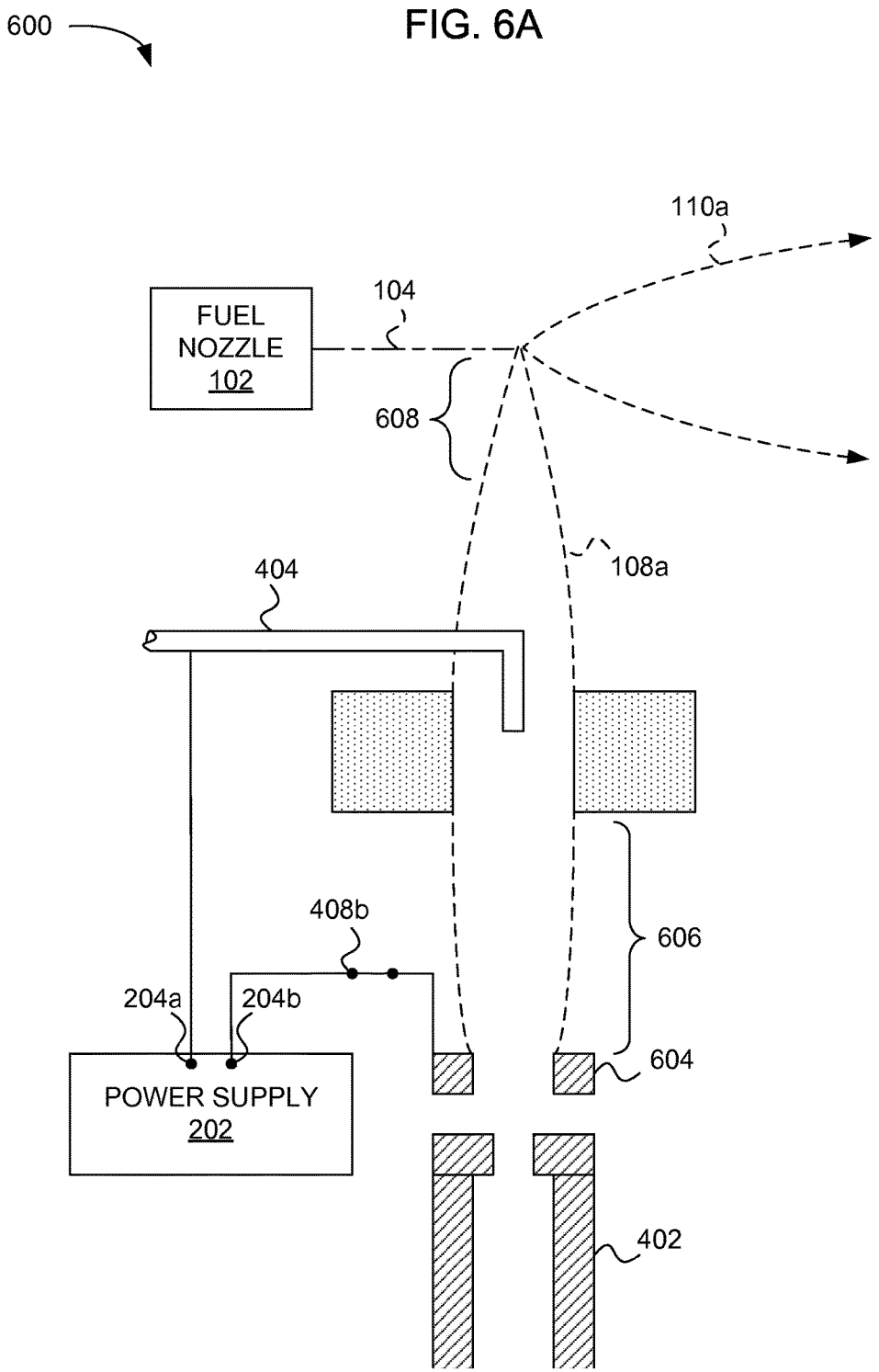
FIG. 6A is a diagram of a combustion system with selectable ignition location, wherein a combustion reaction is ignited at a first location by an extensible ignition flame, according to an embodiment.
Figure 6B:
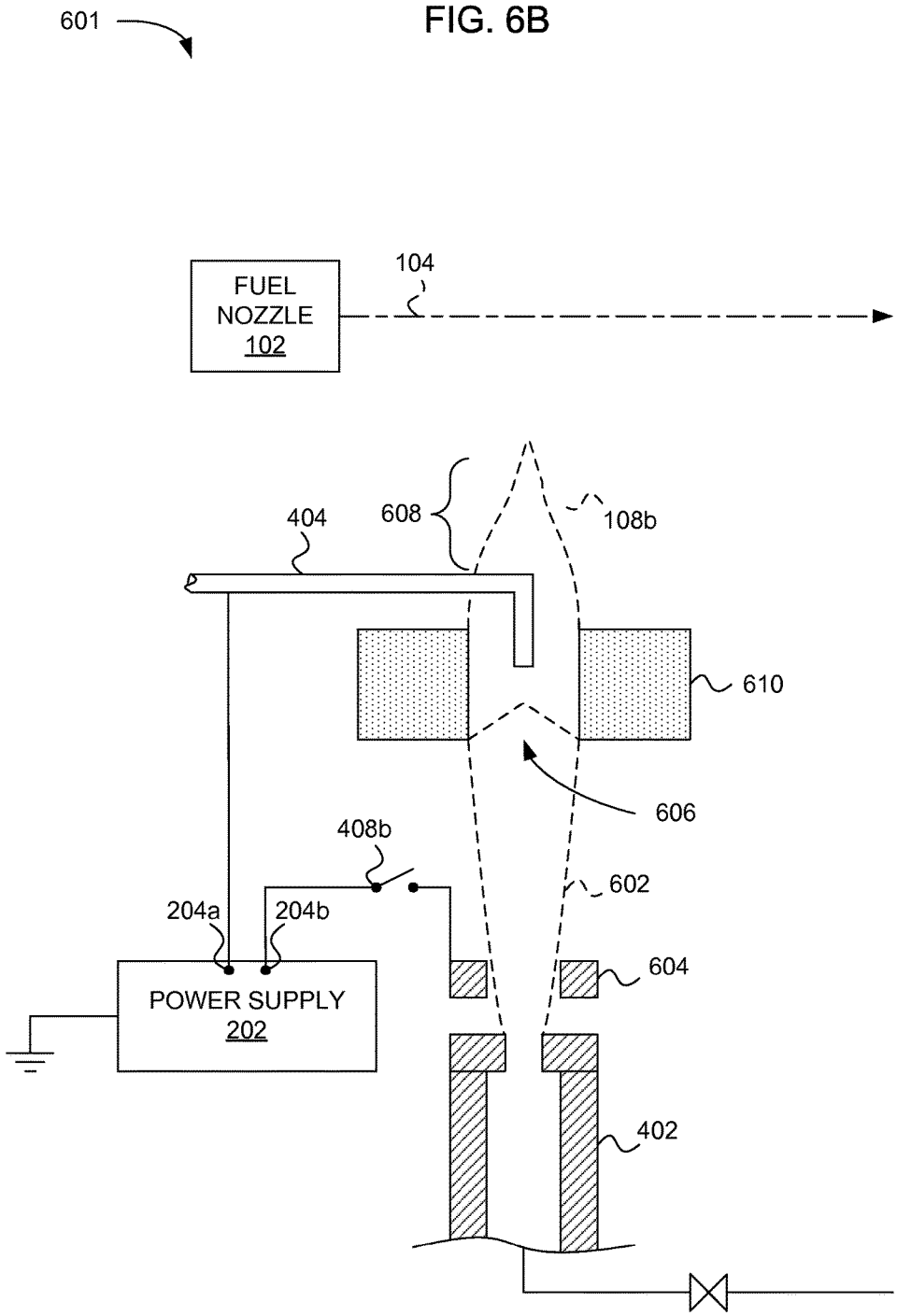
FIG. 6B is a diagram of a combustion system, similar to the system of FIG. 6A, wherein a combustion reaction is not ignited at a first location by the extensible ignition flame, according to an embodiment.

FIG. 6A is a diagram of a combustion system 600 with selectable ignition location, wherein a combustion reaction 110*a* is ignited at a first location 112 by an extensible ignition flame, according to an embodiment. FIG. 6B is a diagram of a combustion system 601, similar to the system 400 of FIG. 6A, wherein a combustion reaction 110*a* is not ignited at a first location 112 by the extensible ignition flame, according to an embodiment.

Referring to FIG. 6A and FIG. 6B, the igniter 106 can further include an igniter fuel nozzle 402 configured to emit an igniter fuel jet 602 and support an ignition flame 108*a*, 108*b*. A high voltage power supply 202 can be configured to output a high voltage on at least one electrical node 204*a*, 204*b*. An ignition flame charging mechanism 404 can be operatively coupled to the high voltage power supply 202 and configured to at least intermittently apply a voltage having a first polarity to the ignition flame 108*a*. A flame holding electrode 604 can be disposed adjacent to the igniter fuel jet 602 output by the igniter fuel nozzle 402. A switch 408*b* can be configured to selectively cause the flame holding electrode 604 to carry a voltage different than the voltage applied by the ignition flame charging mechanism 404.

The flame holding electrode 604 can be configured to pull a proximal end 606 of the igniter flame 108*a* toward the flame holding electrode 604 when the switch 408*b* causes the flame holding electrode 604 to carry the voltage different than the voltage applied by the ignition flame charging mechanism 404. For example, a distal end 608 of the igniter flame 108*a* can extend toward the fuel stream 104 when the proximal end 606 of the igniter flame 108*a* is pulled toward the flame holding electrode 604.

The igniter fuel nozzle 402 can be configured to emit the jet 602 at a velocity selected to cause a proximal end 606 of the igniter flame 108*b* to move away from the flame holding electrode 604 when the switch 408*b* is opened to cause the flame holding electrode 604 to electrically float. For example, a distal end 608 of the igniter flame 108*b* can retract away from the fuel stream 104 when the proximal end 606 of the igniter flame 108*b* moves away from the flame holding electrode 604.

A first flame holder 610 can be configured to hold a proximal end 606 of the igniter flame 108*b* away from the flame holding electrode 604 when the switch 408*b* is open and the flame holding electrode 604 electrically floats. A distal end 608 of the igniter flame 108*b* can retract away from the fuel stream 104 when the proximal end 606 of the igniter flame 108*a* is held by the first flame holder 610.

According to an embodiment, the switch 408*b* can be disposed to open or close electrical continuity between the electrical node 204*b* and the flame holding electrode 604. The electrical node 204*b* can be configured to carry electrical ground. The flame holding electrode 604 can be configured to be pulled to electrical ground when the switch 408*b* is closed. The electrical node 204*b* can be configured to carry a voltage opposite in polarity to the first polarity when the switch 408*b* is closed. The flame holding electrode 604 can be configured to be held at a second electrical polarity opposite to the first polarity when the switch 408*b* is closed and can be configured to electrically float when the switch 408*b* is open.

The ignition flame 108 can be configured for a trajectory 108*b* such that the combustion reaction 110*a* is not ignited by the ignition flame 108 when the ignition flame is retracted.

Figure 7:
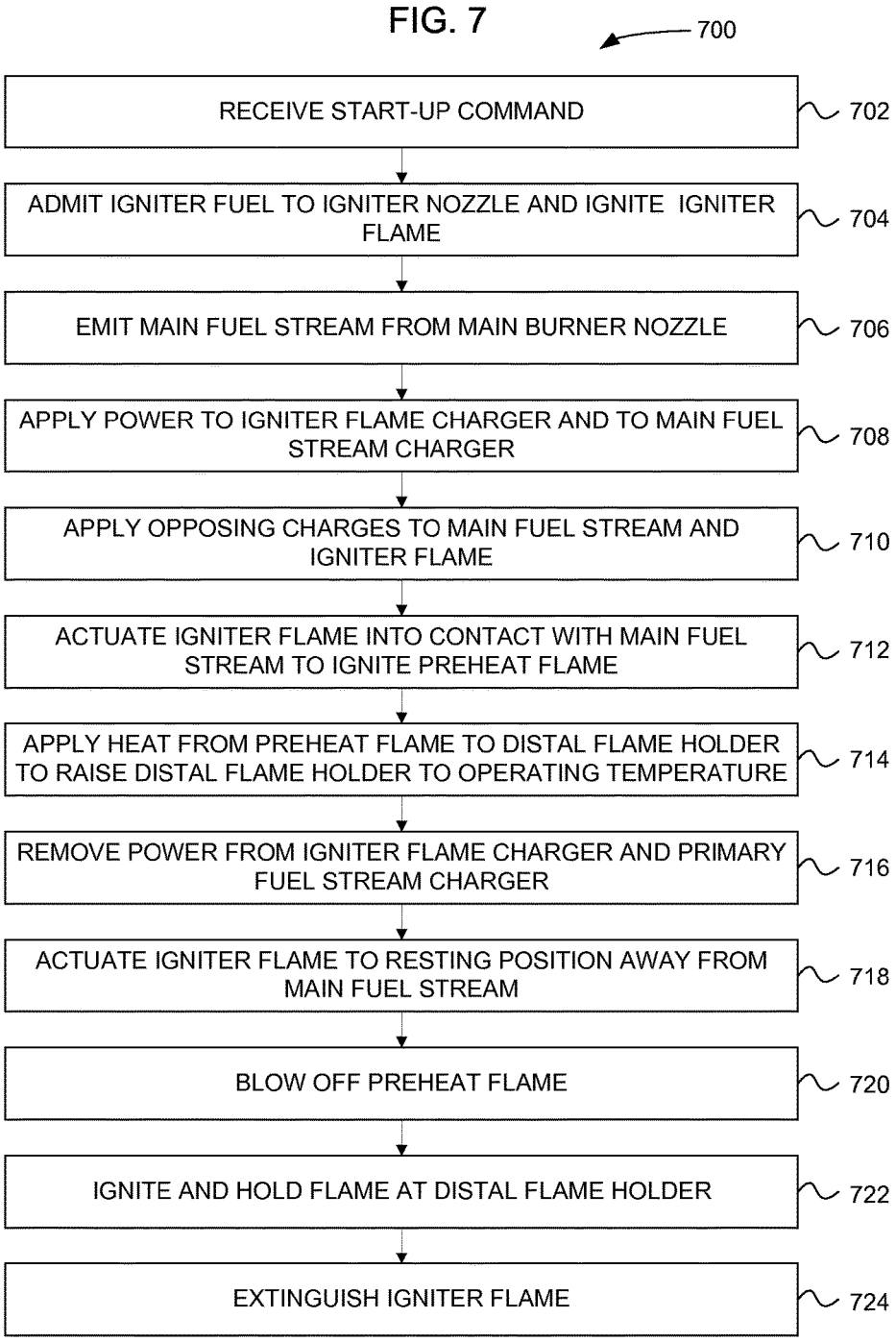
FIG. 7 is a flow chart showing a method of operating a combustion system, according to an embodiment.

FIG. 7 is a flow chart showing a method 700 of operating a combustion system, according to an embodiment. FIG. 7 in particular shows a start-up cycle of a combustion system described in conjunction with FIGS. 1-6B above. Beginning at step 702, and assuming that the system is on standby (no heat production, and no distal combustion present), a start-up command is received.

At step 704, a controller commands an igniter fuel valve to admit fuel to an igniter fuel nozzle, and an igniter flame is ignited, supported by a stream of fuel form the igniter fuel nozzle. Igniting the igniter flame in step 704 can include applying a spark ignition proximate to the to the igniter fuel stream, or can include igniting the igniter fuel with a pilot light, for example. At step 706, the controller controls a main fuel valve to admit fuel to a burner nozzle of the system, which emits a main fuel stream (also referred to as a primary fuel stream) toward a distal flame holder and adjacent to the igniter flame. In step 708, which may occur previous to, simultaneously with, or slightly after step 706, the controller then controls first and second switches to close, electrically coupling an igniter flame charging mechanism and a primary fuel stream charger to respective output terminals of a high-voltage power supply.

Powered by the voltage supply, the igniter flame charging mechanism applies an electrical charge to the igniter flame, while the primary fuel stream charger applies an electrical charge, having an opposite polarity, to the primary fuel stream, in step 710 (which may occur simultaneously with step 706, for example). The opposing charges produce a strong mutual attraction between the igniter flame and the primary fuel stream, tending to draw them together. The inertia of the fuel stream is much greater than that of the igniter flame, so the trajectory of the fuel stream is substantially unchanged, while, in step 712, the attraction causes the igniter flame to deflect toward the primary fuel stream, bringing them into contact. Also in step 712, the igniter flame contacts the main fuel stream to ignite a preheat flame at a preheat flame position between the primary nozzle and a flame holder. Optionally, the preheat flame can be held by a proximal flame holder (e.g., see FIG. 1, 118). In other embodiments, the preheat flame is stabilized by the continuous ignition of the main fuel stream provided by the igniter flame.

In step 714, heat from the preheat flame is applied to the distal flame holder. At the end of a preheat period, during which the distal flame holder is heated to an operating temperature, the controller controls the first and second switches to open, removing power from the igniter flame charging mechanism and the main fuel stream charger, in step 716. Any existing charges in the igniter flame or the main fuel stream quickly dissipate, and the electrical attraction ends. In step 718, the igniter flame returns to a resting position, away from contact with the main fuel stream, and as a result, the preheat flame is "blown off", in step 720. Optionally, the controller can open the main fuel valve and/or increase flow through a combustion air source (e.g., a blower) to increase main fuel stream velocity in order to aid preheat flame blow off in step 720. In other embodiments, the main fuel valve is opened (and/or combustion air flow increased) sufficiently in step 704 that the preheat flame will not stream stabilize or remain stabilized by a proximal flame holder without continuous ignition from the igniter. In still other embodiments, the main fuel stream is increased in velocity during step 714, as the combustion system heats up to maintain stable ignition of the preheat flame.

After preheat flame blow off in step 720, a distal combustion reaction is ignited and held at the distal flame holder in step 722.

In optional step 724, in embodiments in which the igniter flame does not remain continually lit, the controller closes the fuel supply valve that controls the flow of fuel to the igniter fuel nozzle, extinguishing the igniter flame. In systems including a pilot light, the igniter pilot light remains lit. There is an advantage to extinguishing the igniter flame in that the igniter flame can contribute a majority of NOx output by the entire system. A pilot flame is smaller and thus contributes less NOx. Combustion in a porous distal flame holder has been found by the inventors to output NOx below the 1 ppm detection limit of typical NO sensors.

A controller and its operation are described with reference to several embodiments. It will be recognized that, depending in part upon the complexity of a given combustion system, the associated controller can range in widely in complexity and autonomy. The controller can, for example, include, or itself be included as part of, a programmable computer system configured to receive inputs from multiple sensors, and to control operation of many aspects of the combustion system, beyond those related to the systems disclosed above. At the opposite extreme, the controller can be a human interface configured to receive manual input from an operator.

Furthermore, although elements such as a controller, a power supply, and a sensor are described in many of the embodiments as separate elements, they can be combined into more or fewer elements that nevertheless perform the defined functions, or they can be combined with other devices to perform other functions in addition to those described here. For example, according to an embodiment, a combustion system includes a sensor configured to detect the presence of a flame and to shut down the system if no flame is detected. The sensor includes the necessary structure to process and condition the raw sensor signal, and to output a binary enable/disable signal that is received at respective inputs of actuators configured to physically control each of the fuel valves in the system to open and close. While the enable signal is present, the system operates according to the principles disclosed above, and a conventional controller manages its operation. However, in the event that no flame is detected, the signal from the sensor changes to a disable condition, and the actuators close the valves without input from the controller. Thus, that aspect of the controller function is performed by the sensor, but the description and drawings are still intended to describe such distributed functionality.

While various aspects and embodiments have been disclosed herein, other aspects and embodiments are contemplated. The various aspects and embodiments disclosed herein are for purposes of illustration and are not intended to be limiting, with the true scope and spirit being indicated by the following claims.

What is claimed is:

1. A combustion system with flame location control, comprising:

a fuel nozzle configured to output a fuel stream;

an igniter configured to selectably support an igniter flame proximate to a path corresponding to the fuel stream to cause the fuel stream to support a combustion reaction at a first flame location corresponding to the igniter flame during a first time interval; and a distal flame holder configured to hold the combustion reaction at a second flame location defined by the distal flame holder during a second time interval, different than the first time interval, during which the igniter does not support the igniter flame.

2. The combustion system with flame location control of claim 1, wherein the first location is selected to cause the combustion reaction to apply heat to the distal flame holder; and wherein the combustion system is configured to cause the combustion reaction to be held at the first location during a first time interval corresponding to system start-up.

3. The combustion system with flame location control of claim 1, wherein the first flame location is selected to correspond to a stable flame that is relatively rich compared to a lean flame corresponding to the second flame location.

4. The combustion system with flame location control of claim 1, wherein the second flame location is selected to correspond to a low NOx flame that is relatively lean compared to the first flame location.

5. The combustion system with flame location control of claim 1, further comprising:

a proximal physical flame holder disposed adjacent to the path of the fuel stream and configured to cooperate with the igniter to cause the combustion reaction to be held at the first flame location.

6. The combustion system with flame location control of claim 5, wherein the proximal flame holder comprises a flame holding electrode held at a voltage different than a voltage applied to the combustion reaction during the first time interval.

7. The combustion system with flame location control of claim 1, further comprising, a combustion reaction charge assembly configured to apply a voltage to the combustion reaction during at least the first time interval.

8. The combustion system with flame location control of claim 7, wherein the combustion reaction charge assembly includes a corona electrode or ionizer, configured to output charged particles at a location selected to cause the charged particles to exist in the combustion reaction during at least the first time interval.

9. The combustion system with flame location control of claim 7, wherein the combustion reaction charge assembly includes a charge rod configured to carry the voltage to the combustion reaction during at least the first time interval.

10. The combustion system with flame location control of claim 1, wherein the combustion system does not include a proximal flame holder disposed adjacent to the fuel stream; and wherein the igniter is configured to cooperate with the fuel nozzle to cause the combustion reaction to be held in the fuel stream at the first flame location.

11. The combustion system with flame location control of claim 1, wherein the igniter includes an array of igniters configured to selectably cause the combustion reaction to be held at respective locations.

12. The combustion system with flame location control of claim 1, wherein the igniter comprises a cascaded igniter, the cascaded igniter including a primary igniter configured to selectively ignite a secondary igniter, and the secondary igniter being configured to selectively ignite the fuel stream to cause the combustion reaction to be held at the first location.

13. The combustion system with flame location control of claim 1, wherein the igniter further comprises:

an igniter fuel nozzle configured to support an ignition flame;

a high voltage power supply configured to output a high voltage on at least one electrical node;

a ignition flame charging mechanism operatively coupled to the high voltage power supply and configured to apply an electric charge having a first polarity to the ignition flame;

at least one ignition flame deflection electrode disposed to selectively apply an electric field across the ignition flame; and at least one switch configured to selectively cause a high voltage from the at least one electrical node to be placed on the at least one ignition flame deflection electrode.

14. The combustion system with flame location control of claim 13, wherein the ignition flame is configured for a non-deflected trajectory such that the combustion reaction is not ignited by the ignition flame when the ignition flame is not deflected.

15. The combustion system with flame location control of claim 13, wherein the ignition flame is configured for a non-deflected trajectory such that the combustion reaction is ignited at the first location, when the ignition flame is not deflected.

16. The combustion system with flame location control of claim 1, further comprising:

a combustion reaction charger operatively coupled to the fuel nozzle, configured to apply a charge to the combustion reaction or the fuel stream;

wherein the igniter further comprises:

an igniter fuel nozzle configured to support an ignition flame;

a high voltage power supply configured to output a high voltage on at least one electrical node; and an ignition flame charging mechanism operatively coupled to the high voltage power supply and configured to selectively apply an electric charge having a first polarity to the ignition flame;

wherein the high voltage power supply is also operatively coupled to the combustion reaction charger;

wherein the igniter further comprises:

at least one switch configured to selectively cause a high voltage from at least one electrical node to be placed on the at least one of the ignition flame charging mechanism or the combustion reaction charger.

17. The combustion system with flame location control of claim 1, wherein the igniter includes a flow deflector configured to protect the igniter flame from a fuel flow associated with the fuel nozzle.

18. A combustion system, comprising:

a fuel nozzle configured to emit a main fuel stream along a fuel stream path;

a distal flame holder positioned to subtend the fuel stream path a second distance from the fuel nozzle and configured to hold a main combustion reaction supported by the main fuel stream emitted from the fuel nozzle when the distal flame holder is heated to an operating temperature; and an igniter configured to selectively support an igniter flame positioned to ignite the main fuel stream to maintain ignition of a preheat flame between the nozzle and the distal flame holder at a first distance less than the second distance from the nozzle.

19. The combustion system of claim 18, comprising a control mechanism configured to control the igniter to support the igniter flame for a time period sufficient for the preheat flame to heat the distal flame holder to the operating temperature.

20. The combustion system of claim 19, wherein the control mechanism further comprises an electronic controller including a computer processor operatively coupled to an igniter actuator; and a sensor operatively coupled to the electronic controller, configured to detect a characteristic of the distal flame holder corresponding to distal flame holder temperature, and to produce a corresponding temperature signal;

wherein the electronic controller is configured to receive the temperature signal and to cause actuation of the igniter to not ignite the preheat flame at the first location after receiving a temperature signal corresponding to the distal flame holder being at its operating temperature; and wherein the igniter actuator is configured to actuate the igniter to cause the igniter flame to ignite the preheat flame or to not ignite the preheat flame responsive to a signal received from the electronic controller.

21. The combustion system of claim 19, wherein the igniter includes an igniter flame actuator; and wherein the control mechanism is configured to control operation of the igniter flame actuator.

22. The combustion system of claim 21, wherein the control mechanism includes an electronic controller; and wherein the igniter flame actuator is operatively coupled to the electronic controller and configured to actuate the igniter flame responsive to receiving a signal from the electronic controller.

23. The combustion system of claim 18, wherein the igniter includes a plurality of igniters adjacent to the fuel stream path at a plurality of respective first distances along the fuel stream path, each igniter being configured to selectively actuate a respective igniter flame to ignite the preheat flame at a selected subset of the plurality of respective first distances;

wherein the first distance comprises a range of distances less than the second distance, and wherein each of the plurality of igniter flame nozzles is positioned, within the range defining the second distance, a respective distance from the nozzle.

24. The combustion system of claim 18, wherein the distal flame holder includes a plurality of apertures extending therethrough from a first face to a second face, opposite the first face; and wherein the distal flame holder is configured to hold a combustion reaction within the plurality of apertures and substantially between the first and second faces when the distal flame holder is at an operating temperature.

25. A method of operating a combustion system, comprising:

emitting, from a fuel nozzle, a main fuel stream toward a distal flame holder;

preheating the distal flame holder by supporting an igniter flame in a position to fully ignite the main fuel stream and to hold a resulting preheat flame between the fuel nozzle and the distal flame holder; and igniting a distal combustion reaction at the distal flame holder once the distal flame holder has reached an operating temperature.

26. The method of claim 25, wherein the igniting a distal combustion reaction comprises causing a portion of the main fuel stream to pass the preheat flame without igniting.

27. The method of claim 26, wherein causing a portion of the main fuel stream to pass the preheat flame without igniting includes reducing a size of the igniter flame until it is not capable of fully igniting the main fuel stream, and wherein keeping the igniter flame burning includes igniting the distal combustion reaction at a portion of the distal flame holder while keeping the igniter flame burning by supporting the igniter flame at a reduced size.

28. The method of claim 25, wherein igniting the distal combustion reaction comprises:

while supporting the igniter flame at a first position, actuating a second igniter at a second position between the igniter and the distal flame holder to cause the second igniter to support a second igniter flame capable of igniting unburned fuel at the second position;

while supporting the second igniter flame with the second igniter, actuating the igniter to not ignite the preheat flame at the first position; and igniting the preheat flame at the second position with the second igniter flame.

29. The method of claim 28, wherein igniting the distal combustion reaction further comprises:

while supporting the second igniter flame at the second position, actuating a third igniter at a third position between the second position and the distal flame holder and adjacent to the distal flame holder to cause the third igniter to support a third igniter flame capable of igniting unburned fuel at the third position;

while supporting the third igniter flame with the third igniter, actuating the second igniter to not ignite the preheat flame at the second position; and igniting the preheat flame at the third position;

detecting ignition of a portion of the main fuel stream at the distal flame holder; and once the portion of the main fuel stream is ignited at the distal flame holder, actuating the third igniter to not ignite the preheat flame at the third position to extinguish the preheat flame.

30. The method of claim 25, comprising holding the distal combustion reaction substantially within a plurality of apertures extending between an input face and an output face of the distal flame holder, wherein the holding the distal combustion reaction substantially within a plurality of apertures includes combusting a majority of the main fuel stream between the input face and the output face of the distal flame holder.

31. The method of claim 25, wherein:

supporting an igniter flame in a position to fully ignite the main fuel stream includes deflecting the igniter flame into the main fuel stream; and wherein igniting the distal combustion reaction at the distal flame holder includes extinguishing the preheat flame by deflecting the igniter flame away from the main fuel stream.

32. The method of claim 31, wherein:

deflecting the igniter flame into the main fuel stream includes one of applying an electrical charge to the igniter flame or removing an electrical charge from the igniter flame; and wherein deflecting the igniter flame away from the main fuel stream comprises the other one of applying an electrical charge to the igniter flame, or removing an electrical charge from the igniter flame.

33. The method of claim 32, wherein deflecting the igniter flame includes supporting an electrical interaction between the electrical charge applied to the igniter flame and a voltage applied to a field electrode to form an electric field between the igniter flame and the field electrode.

* * * * *